US006171050B1

(12) United States Patent
Johnson

(10) Patent No.: US 6,171,050 B1
(45) Date of Patent: Jan. 9, 2001

(54) LOAD ARM ASSEMBLY FOR A SKID STEER LOADER

(75) Inventor: Robert John Johnson, Madison, SD (US)

(73) Assignee: Gehl Company, West Bend, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/920,582

(22) Filed: Aug. 29, 1997

(51) Int. Cl.[7] ..... E02F 9/00
(52) U.S. Cl. ..... 414/685; 414/918
(58) Field of Search ..... 414/918, 685, 414/686, 722; 212/349, 304

(56) References Cited

U.S. PATENT DOCUMENTS

| | | | | |
|---|---|---|---|---|
| 2,257,386 | * | 9/1941 | Kempe | 52/116 |
| 2,345,620 | | 4/1944 | Mork . | |
| 3,215,292 | | 11/1965 | Halls . | |
| 3,288,316 | * | 11/1966 | West | 414/685 X |
| 3,995,761 | | 12/1976 | Hurlburt . | |
| 4,295,779 | | 10/1981 | Shumaker . | |
| 4,705,449 | * | 11/1987 | Christianson et al. | 414/685 |
| 4,903,418 | * | 2/1990 | Loudon | 414/722 X |
| 5,009,566 | * | 4/1991 | Asche | 414/722 |
| 5,078,568 | * | 1/1992 | Lynnes | 414/685 X |
| 5,108,253 | * | 4/1992 | Kobayashi et al. | 414/918 X |
| 5,125,787 | * | 6/1992 | Ball et al. | 414/722 |
| 5,169,278 | | 12/1992 | Hoechst et al. . | |
| 5,232,330 | * | 8/1993 | Rae et al. | 414/918 X |
| 5,511,932 | | 4/1996 | Todd et al. . | |
| 5,609,464 | * | 3/1997 | Moffitt et al. | 414/685 |
| 5,611,657 | * | 3/1997 | Peterson | 414/722 |

* cited by examiner

*Primary Examiner*—Donald W. Underwood
(74) *Attorney, Agent, or Firm*—Andrus, Sceales, Starke & Sawall, LLP

(57) ABSTRACT

A mobile loading machine having a frame and an operator's cab mounted thereon has a load arm assembly adapted to be pivotably mounted at a rear end of the frame, and support a power tool between a lowered position and a raised position at a forward end thereof. The load arm assembly includes an outer load arm section for supporting the tool, an inner load arm section pivotably mounted to the frame independent of the cab, and an intermediate load arm section integrally connected between the outer and inner load arm sections. The intermediate load arm section and inner load arm section are in overlapping relationship with each other such that the intermediate load arm section is positioned alongside a lowermost portion of the cab when the load arm assembly is in the lowered position to maximize the lateral visibility of the operator from the cab. The load arm assembly is a channel construction having a top wall and a bottom wall connected by a pair of sidewalls and the load arm assembly supports a supply line arrangement running along the load arm assembly to the power tool. A retaining device is positioned on the bottom wall between the extended portions of the sidewalls for protecting and concealing the supply line arrangement. A hydraulic cylinder arrangement is connected to the load arm assembly for moving the load arm assembly between the extended position and the retracted position. A safety bar is located adjacent the underside of the load arm assembly. The safety bar is retained in an inoperative position between the extended portions of the sidewalls and is movable to an operative position for holding the hydraulic cylinder arrangement in the extended position and preventing lowering of the load arm assembly.

35 Claims, 3 Drawing Sheets

FIG. 3
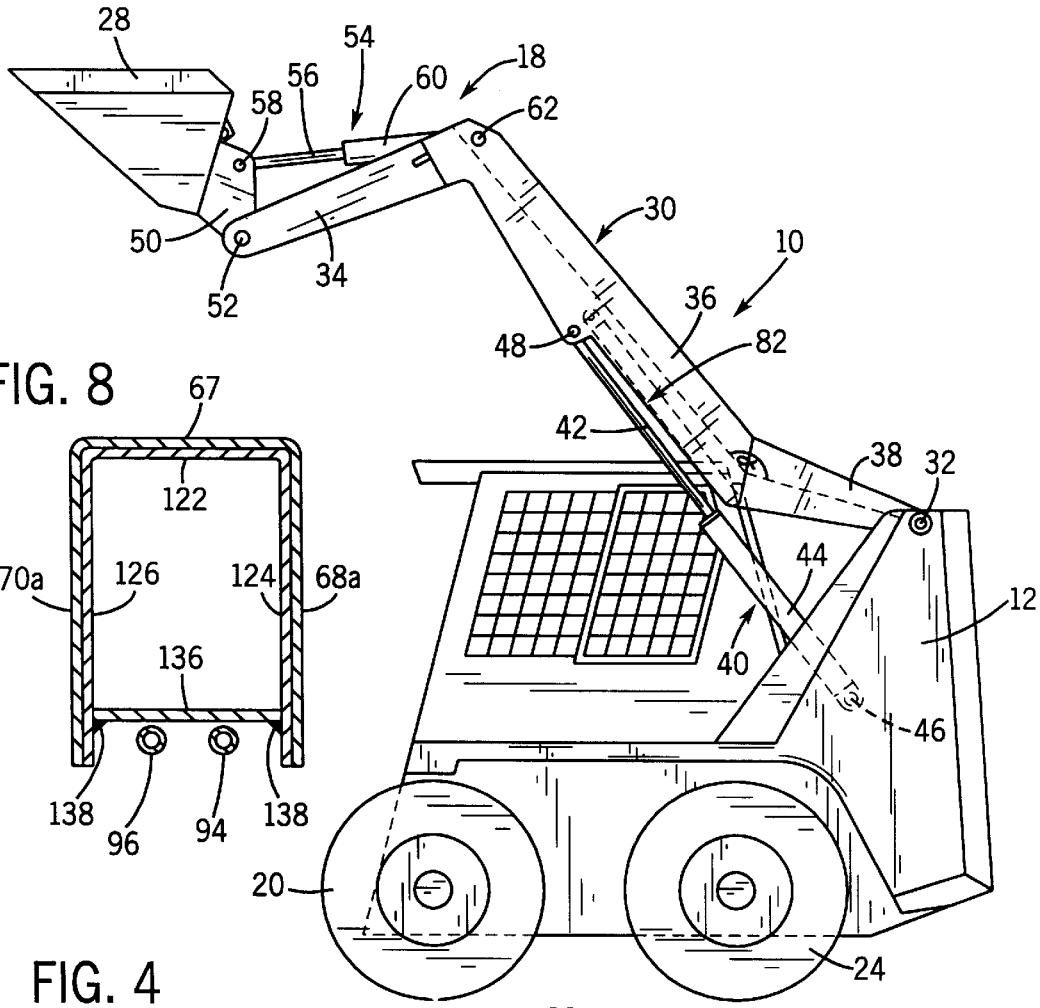
FIG. 8
FIG. 4
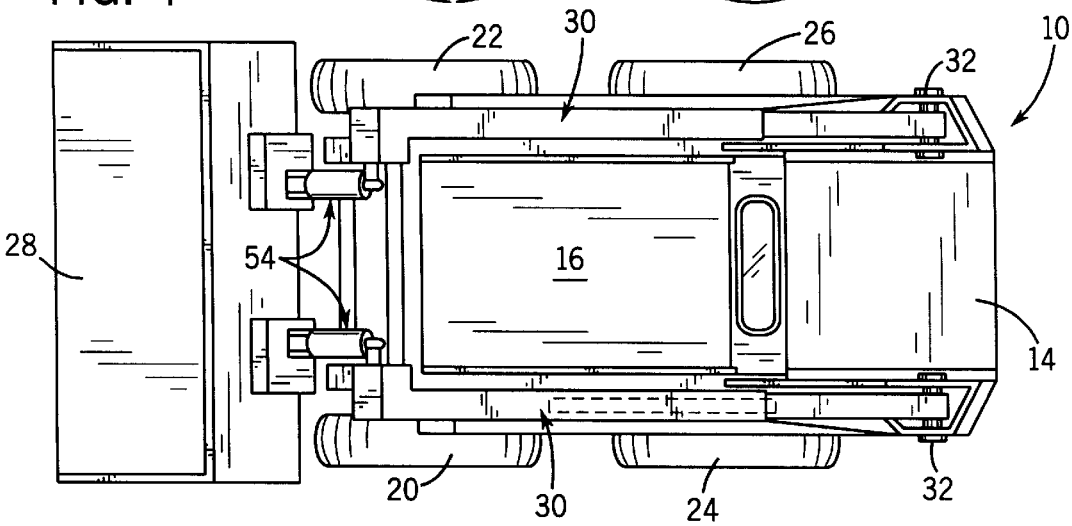

LOAD ARM ASSEMBLY FOR A SKID STEER LOADER

FIELD OF THE INVENTION

This invention relates generally to improvements in material handling and loading equipment, and more particularly, pertains to a load arm assembly for use with a mobile loading machine, such as a skid steer loader.

BACKGROUND AND SUMMARY OF THE INVENTION

Skid steer loaders are known to provide a high degree of maneuverability and a wide range of applications in the agricultural, industrial and construction fields. These loading machines generally include an engine, a boom assembly and an operator's cab mounted to a main frame supported by four ground wheels. A main drive system is coupled to the engine. The loading machine is maneuvered by driving the wheels on one side at a different speed and/or direction from those on the other side resulting in a revolving motion governed by the relative speed of the wheels. The boom assembly in a skid steer loader typically includes a pair of load arm assemblies pivotably mounted directly to the main frame or a support frame extending upwardly therefrom. Material handling attachments such as a bucket or other working attachment are usually mounted on the forward end of the load arm assemblies. A separate hydraulic system is usually employed in skid steer loaders to power the boom assembly between raised and lowered positions via hydraulic cylinders coupled to the load arm assemblies. This same system may be used to actuate one or two tilt cylinders which pivot or "curl" the working attachment relative to the load arm assemblies. Typically, a pair of hand or foot controls installed in the operator's cab control the flow of hydraulic fluid to the load arm and tilt cylinders.

Besides material handling buckets, various other attachments such as pallet forks, earth augers, backhoes, trenchers, etc., which include their own particular hydraulic motors and/or cylinders, are commonly mounted to the boom assembly. An auxiliary hydraulic system is used to control the flow of hydraulic fluid between a pump on the frame and the hydraulic motor in the vicinity of the front-mounted attachment. It is the usual practice in the prior art for the flow of hydraulic fluid to be channeled from the pump to the hydraulic motor associated with the attachment by means of a plurality of hydraulic tubes which are generally directed along the load arm assemblies.

In the use of skid steer loaders as described above, the load arm extends past the side of the cab and can effect the visibility of the operator. In the prior art, the load arms extend linearly in a downward and forward direction from their pivoting attachment to the upwardly extending supports at the rear of the machine, and thus are in the operator's line of sight when lowered. A problem may arise in occcasional damage to the hydraulic tubing feeding the bucket or other working attachment on the front of the load arm assemblies due to adverse environmental conditions.

Accordingly, there is a desire for a load arm assembly capable of being mounted on the loading machine frame so as to maximize the lateral visibility of the operator when the boom assembly is in the lowered position and the operator wishes to perform turning maneuvers. Also, it is desirable to provide a safety arm having a relatively simple but reliable structure for preventing a boom assembly from lowering beyond a given height. Furthermore, it is advantageous to protect, conceal and maintain the integrity of the hydraulic tubing supplying the bucket or other working attachment.

It is one object of the present invention to provide a loading machine with a load arm assembly having a shape and a construction conducive to improved operator visibility when lowered. It is another object of the present invention to provide a load arm assembly for protectively and concealably retaining along the underside thereof a supply line arrangement feeding a working attachment. It is also an object of the present invention to provide a pivotable load arm assembly having an anti-lowering arrangement for maintaining the boom assembly at a predetermined raised position, such as for servicing or the like. Yet another object of the present invention is to provide a load arm assembly having a double channel construction capable of withstanding the working stresses associated with operation of a mobile loading machine and facilitating manufacture.

One aspect of the invention relates to a mobile loading machine having a frame and an operator's cab mounted thereon, and a load arm assembly adapted to be pivotably mounted at a rear end of the frame and to support a tool between a lowered position and a raised position at a forward end thereof. The load arm assembly includes an outer load arm for supporting the tool, an inner load arm pivotably mounted to the frame independent of the cab, and an intermediate load arm integrally connected between the outer and inner load arms. The intermediate load arm is in overlapping relationship with the inner load arm and is fixed thereto in a joint such that the intermediate load arm is positioned alongside a lowermost portion of the cab and the inner load arm projects upwardly and rearwardly of the cab from the intermediate load arm when the load arm assembly is in the lowered position to maximize the lateral visibility of the operator from the cab when the load arm assembly is lowered. The inner load arm and the intermediate load arm have intersecting longitudinal axes, the included angle between the axes being greater than 90°. The intermediate load arm has a top wall, a bottom wall and a pair of connecting sidewalls extending downwardly beyond the bottom wall. The inner load arm has an upper wall, a lower wall and a pair of connecting side segments, the upper wall and side segments of the inner load arm being received within the top wall and the sidewalls of the intermediate load arm. The load arm assembly includes a brace connecting the bottom wall of the intermediate load arm with the lower wall of the inner load arm. The inner load arm extends downwardly and forwardly between the frame and the cab, the intermediate load arm extends downwardly and forwardly alongside the cab and the outer load arm extends substantially downwardly in front of the cab when the tool is in the lowered position.

Another aspect of the invention relates to a loading machine with a tubular load arm assembly having a top wall and a bottom wall connected by a pair of sidewalls for supporting a power tool fed by a supply line arrangement running alongside the load arm assembly. A retaining device is positioned on the bottom wall between extended portions of the sidewalls for protecting and concealing the supply line arrangement.

Another aspect of the invention relates to a mobile loading machine having a movable load arm assembly for supporting a power tool connected with a supply line arrangement. An inverted, generally U-shaped channel defines a top wall and a pair of spaced apart sidewalls depending therefrom. A bottom wall is connected across the sidewalls and closes the U-shaped channel to form a tubular support member. A clamping device is secured to the bottom wall for retaining the supply line arrangement adjacent thereto, the depending sidewalls being constructed and arranged to conceal, protect and allow accessibility to the supply line arrangement. The depending sidewalls are substantially parallel to one another and the bottom wall is substantially parallel to the top wall. The bottom wall may be in the form of an upright U-shaped channel having a transverse portion and a pair of upright side portions, each of which is secured to an inside surface of a respective sidewall. The supply line arrangement includes a hydraulic cylinder and a pair of hydraulic tubes for feeding hydraulic fluid to the hydraulic cylinder. The clamping device includes an upper yoke member connected to the underside of the bottom wall, a bottom yoke member engageable with the upper yoke member and a fastener threadably received in aligned openings formed in the upper yoke member, the lower yoke member and the bottom wall so as to clampingly retain the supply line arrangement between the upper and lower yoke members beneath the bottom wall and between the depending sidewalls. The depending sidewalls extend downwardly beyond the clamping device.

Yet another aspect of the invention relates to a loading machine having a frame, a load arm assembly pivotably mounted to the frame and a power device connected to the load arm assembly and movable between an extended position and a retracted position for respectively obtaining a raised condition and a lowered condition of the load arm assembly. The improvement resides in an anti-lowering arrangement located on an underside of the load arm assembly for holding a power device in the extended position and preventing lowering of the load arm assembly. The anti-lowering arrangement includes a safety bar pivotably mounted upon a pair of sidewalls depending from the load arm assembly between an inoperative position wherein the safety bar is protectively retained between the sidewalls and disengaged from the power device, and an operative condition wherein the safety bar is released from between the sidewalls to pivot downwardly by gravity into obstructing contact with the power device so as to prevent retraction of the power device and maintain the raised condition of the load arm assembly.

Still yet another aspect of the invention relates to an anti-lowering arrangement for a loading machine having a frame, at least one load arm assembly pivotably connected to the frame and a power device associated with the load arm assembly and movable between a retracted position and an extended position for lowering and raising the load arm assembly. A safety bar has a first end pivotably mounted to the load arm assembly and a second end movable between an inoperative position wherein the bar is connected to the load arm assembly and spaced from the power device, and an operative position wherein, with the power device in the extended position, the bar is released and pivots away from the load arm assembly into obstructing contact with the power device to hold the power device in the extended position and prevent lowering of the load arm assembly. The power device is a hydraulic cylinder having a rod portion telescopically mounted within a cylinder portion. The second end of the safety bar is engageable with both the rod and cylinder portions when the power device is in the extended position. The safety bar is mounted above the power device, and is formed as an inverted, U-shaped channel having an upper wall and a pair of depending sidewalls provided with a pair of aligned openings therethrough. The load arm assembly includes a pair of depending sidewalls formed with aligned apertures therethrough. A retaining pin is passable through the aligned openings of the safety bar and the aligned apertures of the load arm assembly to retain the safety bar is in the inoperative position. The length of the retaining pin is longer than the distance between the sidewalls of the load arm assembly so that the ends of the pin will extend beyond the sidewalls of the load arm assembly when the safety pin is in the inoperative position. The safety bar is concealed between the sidewalls of the load arm assembly when the safety bar is in the inoperative position. The length of the safety bar is substantially equal to the length of the rod portion of the hydraulic cylinder. The first end of the safety bar and one end of the power device are pivotably mounted to the depending sidewalls of the load arm assembly.

Various other objects, features and advantages of the invention will be made apparent from consideration of the following description taken together with the drawings.

BRIEF DESCRIPTION OF THE SEVERAL VIEWS OF THE DRAWINGS

The drawings illustrate the best mode presently contemplated of carrying out the invention. In the drawings:

FIG. 3 is a view similar to FIG. 2 showing the load arm assemblies in a raised position;

FIG. 4 is a top plan view of the skid steer loader shown in FIG. 1;

FIG. 5A is a detail view of a welded joint between an intermediate load arm section and an inner load arm section of each load arm assembly;

FIG. 8 is a sectional view taken on line 8—8 of FIG. 5.

DETAILED DESCRIPTION OF THE DRAWINGS

Figure 1:
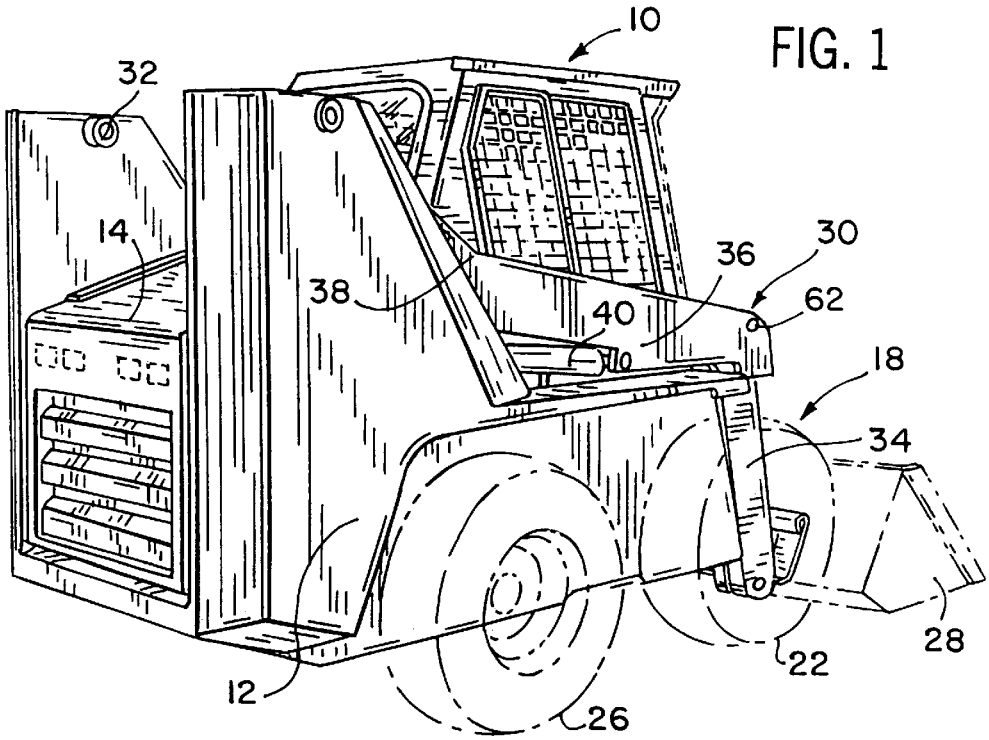
FIG. 1 is an isometric view of a skid steer loader embodying the load arm assemblies of the present invention.
Figure 2:
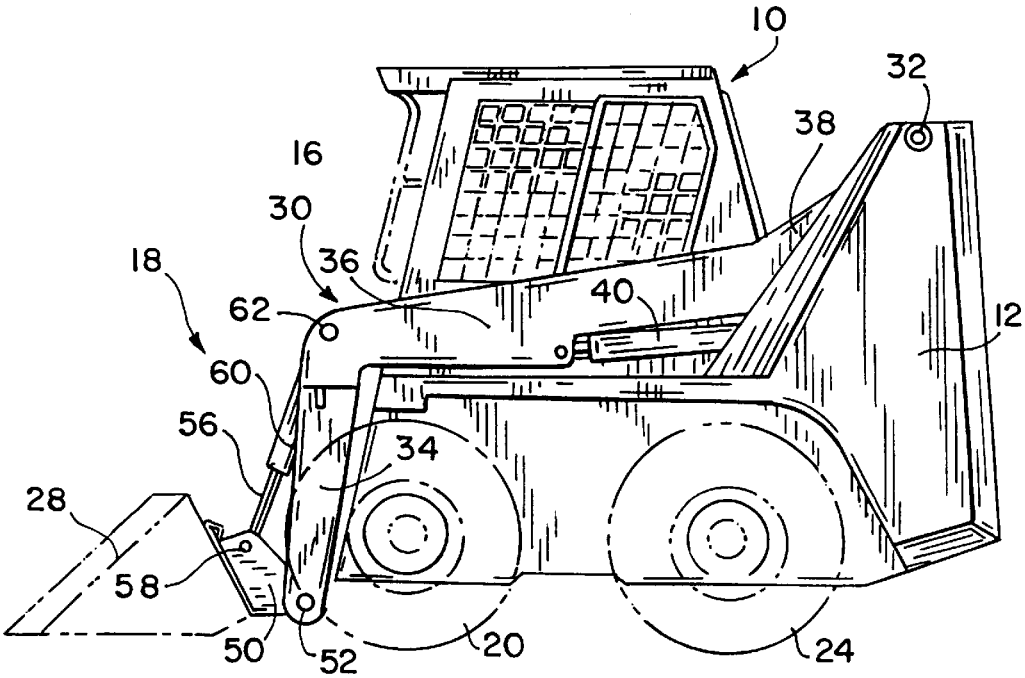
FIG. 2 is a left side elevational view thereof with the load arm assemblies in a lowered position.

Referring now to the drawings, FIGS. 1–4 illustrate a mobile loading machine 10 in the preferred form of a skid steer loader. Loader 10 includes a main frame 12, an engine 14, an operator's cab 16 and a boom assembly 18, all of which are supported by a pair of front wheels 20,22 and rear wheels 24,26 rotatably mounted on the frame 12. Cab 16 includes rollover protection structure and falling object protection structure, as is known in the art.

Boom assembly 18 comprises a bucket 28, or other working attachment or tool, movably mounted between a lowered position (FIG. 2) and a raised position (FIG. 3) by a pair of spaced load arm assemblies 30. Each load arm assembly 30 is pivotably mounted to pivots 32 on the upper rear portion of frame 12 and the opposite end of each load arm assembly 30 supports the bucket 28 or other attachment. Because elements of the left side of the skid steer loader 10 are paired with similar elements on the right side, only the left side of the boom structure will be described.

Each load arm assembly 30 includes an outer load arm section 34, an intermediate load arm section 36 and an inner load arm section 38, all of which are joined together. As seen best in FIG. 2, the inner load arm section 38 extends downwardly and forwardly between pivot 32 at the rear end of frame 12 and the cab 16, the intermediate load arm section 38 extends downwardly and forwardly alongside the cab 16 and the outer load arm section 34 extends mostly downwardly and slightly forwardly in front of the cab 16 when the tool 28 is in the lowered position of FIG. 2. Outer load arm section 34, intermediate load arm section 36, and inner load arm section 38 do not pivot or articulate relative to one another and are preferably rigidly fixed together such as by welding.

Each load arm assembly 30 is associated with a power device, such as a hydraulic cylinder 40 having a rod portion 42 telescopically mounted in a cylinder portion 44. Each hydraulic cylinder 40 has a cylinder end pivotably connected to a pivot point 46 (FIG. 3) on the frame 12 located downwardly and forwardly of the pivots 32. A rod end is movably mounted to a pivot point 48 located generally between the ends of and at the bottom of the intermediate load arm section 36, as will be further described hereafter. Activation of each hydraulic cylinder 40 causes the load arm assemblies 30 to swing about pivots 32, raising and lowering the boom assembly 18.

Bucket 28 is removably attached to an attachment mechanism at the forward end of each load arm assembly 30 which includes a mounting plate assembly 50 that rotates about a pivot pin 52 at a free end of the outer load arm 34. Each of a pair of hydraulic cylinders 54 has a rod portion 56 pivotally joined to the top of mounting plate assembly 50 at 58, and a cylinder portion 60 pivotally connected to the forward end of intermediate load arm section 36 at a pivot point 62. Actuation of each hydraulic cylinder 54 will rotate or curl the mounting plate assembly 50, and thereby the bucket 28 or other tool attached thereto relative to the load arm assemblies 30. Hydraulic cylinders 40,54 are generally fed from a common hydraulic source located on the frame 12 of the skid steer loader 10 in the vicinity of the pivot point 46. A supply line arrangement 63 (FIG. 5) comprised of a plurality of tubes is supported along the length of each load arm assembly 30 for feeding hydraulic fluid between the source and the tilt cylinder 54.

Figure 5:
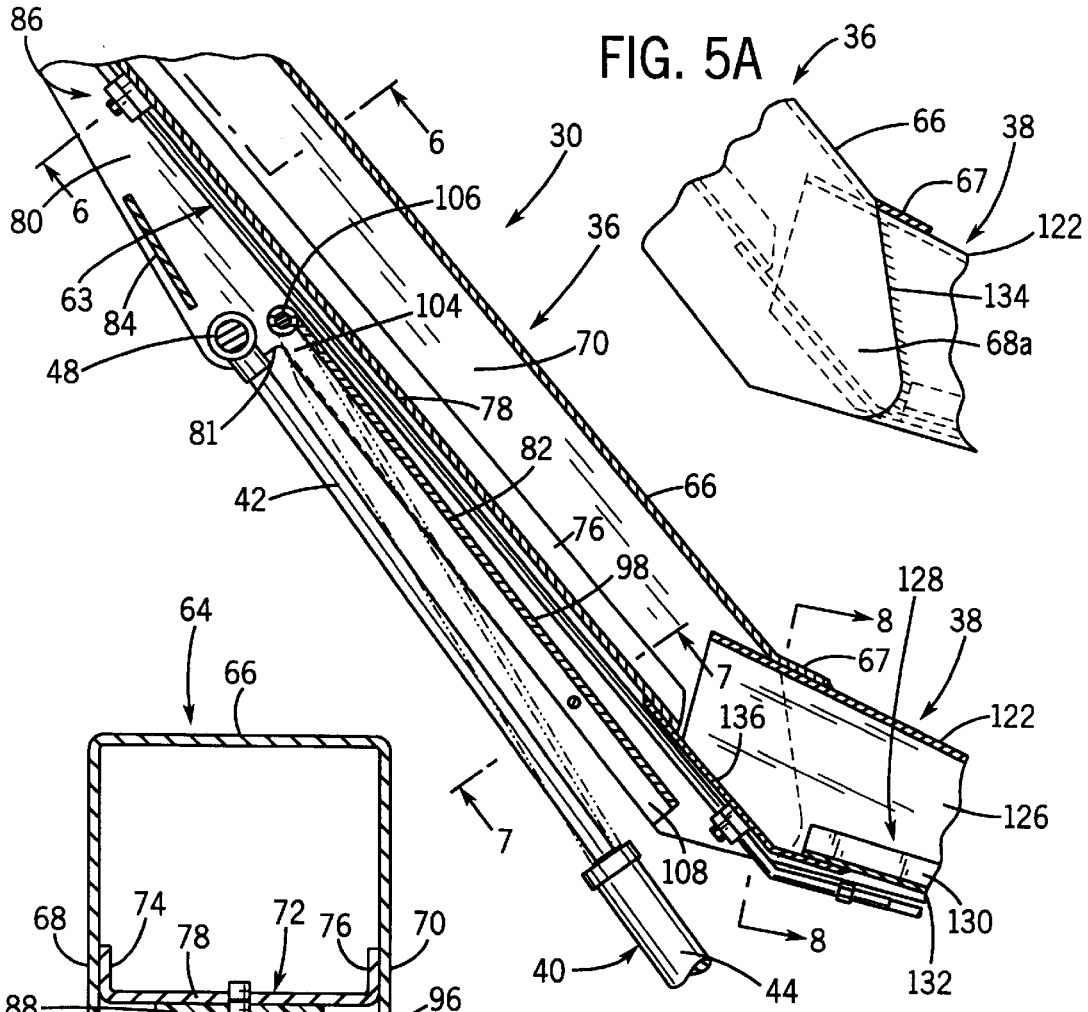
FIG. 5 is an enlarged, detail view in partial cross-section of the load arm assemblies illustrated in FIG. 3.
Figure 6:
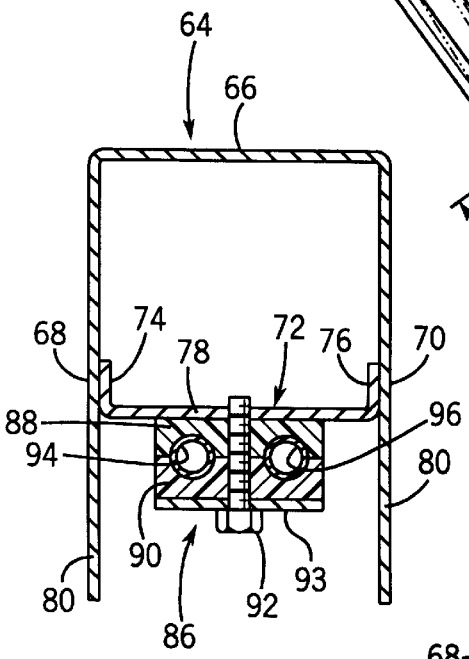
FIG. 6 is a sectional view taken on line 6—6 of FIG. 5.

Referring now to FIGS. 5, 5A and 6, each intermediate load arm section 36 is a tubular construction formed by an inverted U-shaped channel 64 defining a top wall 66 and a pair of spaced apart, parallel side walls 68,70 depending therefrom. The inner end of top wall 66 is provided with an angular, bent extension 67 and side walls 68,70 terminate in nose portions 68*a*, 70*a* to accommodate inner load arm 38, as will be more fully described below. Disposed across and extending between the side walls 68,70 is an upright, U-shaped channel 72 having upright side portions 74,76 welded on the inside surfaces of the side walls 68,70 and a transverse portion 78 defining a bottom wall which is substantially parallel to the top wall 66 and closes the channel 64. Depending side walls 68,70 extend downwardly beyond the bottom wall 78 in an increasing amount in a direction from the forward end of intermediate section 36 towards pivot points 48, to form a skirt 80 which supports the rod end 42 of the hydraulic cylinder 40 at pivot point 48, defined by a pin extending between side walls 68,70. Pin 48 is located slightly forwardly of the rear end of skirt 80, shown at 81 (FIG. 5). A reinforcing plate 84 (FIG. 5) is connected, such as by welding, across the depending side walls 68,70 to strengthen and rigidify the skirt area.

A clamping device 86 is secured to the bottom wall 78 for controllably retaining the supply line arrangement 63. In particular, as shown in FIG. 6, a resilient upper yoke member 88 engages and is connected to the underside of bottom wall 78 and a resilient bottom yoke member 90 is cooperably engageable against the upper yoke member 88. A fastener 92 extends through a clamping plate 93 and aligned openings formed in each of the yoke members 88,90 and is threadedly received in an opening formed in the bottom wall 78, so as to clampingly retain the supply line arrangement 63 beneath the bottom wall 78 and between the depending side walls 68,70. Alternatively, a weld nut (not shown) secured to the top side of the bottom wall 78 could be used to receive the fastener 92 and hold the clamping device 86 in place.

The supply line arrangement 63 is depicted as a pair of hydraulic tubes 94,96 for delivering hydraulic fluid to each end of hydraulic cylinder 54. However, it should be understood that any number of supply lines can be reasonably supported from any number of clamping devices depending on the equipment on the load arm assembly. For example, in an embodiment incorporating a high flow hydraulic system, a series of five (5) hydraulic tubes are mounted to bottom wall 78 for supplying hydraulic fluid to and from tilt cylinder 54 and to hydraulic couplings at the forward end of intermediate load arm section 36 for connection to hydraulically operated attachments mounted to mounting plate assembly 50. In this embodiment, a pair of additional tubes are vertically aligned with tubes 94,96 and spaced therefrom, and a resilient spacer, having grooves in both its upper and lower surfaces, is placed between tubes 94,96 and the additional tubes, to form a stacked arrangement of four (4) tubes clamped to bottom wall 78 by clamping plate 93 and fastener 92. A fifth tube is connected to clamping plate 93 via a strap which encircles the tube and is secured to clamping plate 93 utilizing a fastener received within a recess formed in bottom yoke member 90.

It should likewise be appreciated that the supply line arrangement 63 may be utilized to transfer air or electricity if pneumatic or electrical actuators are employed. With the construction described above, the depending side walls 68,70 extend beneath the clamping device 86 to effectively conceal and protect the supply line arrangement 63 during use and from weather or other environmental conditions. The clamping device 86 also prevents the supply line arrangement 63 from becoming snagged with or struck by other equipment or objects at the operating site. Although the depending side walls 68,70 protect and conceal the supply line arrangement 63, the tubes 94,96 remain accessible for inspection and service beneath the load arm assemblies 30.

Figure 7:
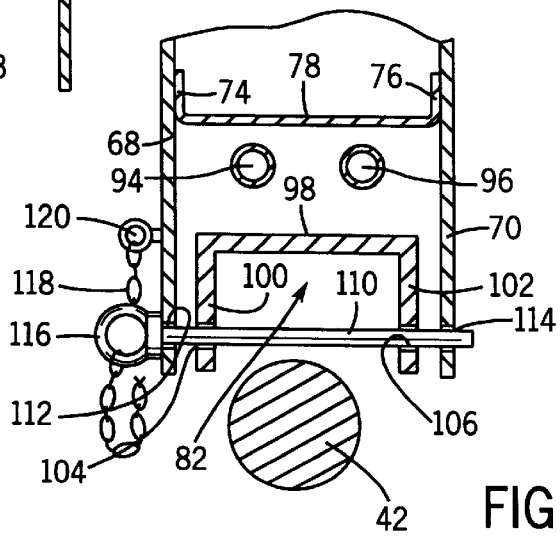
FIG. 7 is a sectional view taken on line 7—7 of FIG. 5.

With reference to FIGS. 5 and 7, an anti-lowering arrangement is located on an underside of one of the load arm assemblies 30 for holding the hydraulic cylinder 44 in its extended position and preventing lowering of the load arm assembly 30, such as during servicing or when it is otherwise desired to maintain lift cylinder 44 in its extended position. The anti-lowering arrangement is embodied in the safety bar 82 which is formed from an inverted U-shaped channel having an upper wall 98 and a pair of depending side walls 100, 102 provided with a pair of aligned openings 104,106 therethrough. The length of safety bar 82 is dimensioned to be substantially equal to the fully extended length of rod 42. Safety bar 82 has a first end 104 swingably mounted at pivot 106 on skirt 80 at a point above pivot 48. A second end 108 of the safety bar 82 is movable between an inoperative position (shown in full lines in FIG. 5), and an operative position (shown in phantom lines in FIG. 5). In the inoperative position, bar 82 is connected to load arm assembly 30 and is spaced above hydraulic cylinder 44 and rod 42. That is, a retainer pin 110 having a length greater than the distance between side walls 68,70, is passable through aligned apertures 112,114 formed in the lower portion of side walls 68,70 and aligned openings 104,106 formed in safety bar side walls 100,102, so as to retain and neatly conceal safety bar 82 between the side walls 68,70. Retaining pin 110 includes a finger ring 116 which is attached by a chain 118 to a circular retainer 120 fixed on side wall 68. When the load arm assembly 30 reaches the fully extended position shown in FIG. 5, the retaining pin 110 is removed by an operator and the second end 108 of safety bar 82 is then released and falls downwardly by gravity into the operative position wherein the upper wall 98 is in obstructing contact with rod 42 and the radially enlarged end of cylinder 44. When it is desired to lower the boom assembly 18, safety bar 82 is disengaged from contact with hydraulic cylinder 44, so that the rod 42 can be retracted, after which safety bar 82 is placed in its inoperative position and the retaining pin 110 is used to hold the safety bar 82 in its inoperative position until further use is desired.

As seen in FIGS. 5, 5A and 8, inner load arm 38 section, like intermediate load arm section 36, is an inverted U-shaped channel construction having an upper wall 122 and a pair of substantially parallel, depending side segments 124,126. Disposed across side segments 124,126 at the bottom thereof is an upright channel 128 having upright side portions 130 (only one of which is seen in FIG. 5) welded to the inside surfaces of side segments 124,126, and a transverse portion 132 defining a lower wall. The forward end of inner load arm section 38 is slidably received within the rearward end of intermediate load arm section 36 with angular extension 67 and upper wall 122, and side walls 68,70 and side segments 124,126 being in overlapping relationship with one another. Welds 134 distributed along the interfaces between the upper periphery of nose portions 68*a*, 70*a* and the side segments 124,126 firmly connect the intermediate load arm section 36 and the inner load arm section 38 in an angular joint wherein the intermediate load arm 36 and the inner load arm 38 have intersecting longitudinal axes. A bent brace plate 136 is welded at 138 to the bottom wall 78 of the intermediate load arm section 36 and the lower wall 132 of inner load arm section 38, and to side walls 68,70 and side segments 124,126, to close the opening between bottom wall 78 and lower wall 132 and to reinforce the joint between intermediate load arm section 36 and inner load arm section 38. The included angle between the intersecting axes of intermediate and inner load arm section 36,38, respectively, is an obtuse angle greater than 90° such that the intermediate load arm section 36 is positioned alongside a lowermost portion of the cab 16 when the load arm assembly 30 is in the lowered position of FIG. 2. The effect of this jointed construction is to improve the operator's line of sight and to maximize his lateral visibility when load arm assembly 30 is in its lowered position, so that the operator can maneuver the skid steer loader 10 with maximum visibility when load arm assembly 30 is lowered.

With the load arm assembly 30 in the lowered position, the inner load arm section 38 projects upwardly and rearwardly of the cab 16 from the intermediate load arm section 36. The load arm assembly 30 is attached to the loader frame 10 at one pivot point 32 only, and requires no additional links on the loader 10 such as those connecting the inner load arm 30 with the cab 18.

While the invention has been described with reference to a preferred embodiment, those skilled in the art will appreciate that certain substitutions, alterations, and omissions may be made without departing from the spirit throughout. Accordingly, the foregoing description is meant to be exemplary only, and should not be deemed limitative on the scope of the invention set forth in the following claims.

I claim:

1. In a mobile loading machine having a frame and an operator's cab mounted thereon, a load arm assembly adapted to be pivotably mounted at a rear end to the frame, and to support a tool between a lowered position and a raised position at a forward end thereof, the load arm assembly comprising:

an outer load arm section for supporting the tool;

an inner load arm section pivotably mounted to the frame; and an intermediate load arm section connected between the outer and inner load arm sections;

wherein a first one of the inner and intermediate load arm sections includes a first top wall, a first bottom wall and a first pair of sidewalls extending therebetween which cooperate to define an outwardly open passage and wherein a second one of the inner and intermediate load arm sections includes a second top wall, a second bottom wall and a second pair of connecting sidewalls extending therebetween;

wherein the intermediate load arm section and the inner load arm section are interconnected at a joint at which the second one of the load arm sections is slidably received within the passage defined by the first one of the load arm sections, wherein the first and second top walls overlap and are interconnected with each other, the first and second bottom walls are interconnected with each other, and the first and second pairs of sidewalls overlap and are interconnected with each other;

wherein the first top and bottom walls terminate at outer portions which are bent relative to inner portions defined thereby, such that the passage extends along a longitudinal axis oriented at an angle relative to a longitudinal axis along which the remainder of the first load arm section extends.

2. The load arm assembly of claim 1, wherein the intermediate load arm section extends along a longitudinal axis, and wherein an angle defined by the longitudinal axes of the inner load arm section and the intermediate load arm section is greater than 90°.

3. The load arm assembly of claim 1, wherein the intermediate load arm section has a top wall, a bottom wall and a pair of connecting sidewalls extending downwardly beyond the bottom wall, and the inner load arm section has an upper wall, a lower wall and a pair of connecting side segments, wherein the upper wall and the side segments of the inner load arm section are received within a passage defined by the top wall and the sidewalls at the rearward end of the intermediate load arm section, and are arranged in overlapping relationship and are connected to the top wall and sidewalls of the intermediate load arm section to form the joint between the inner and intermediate load arm sections.

4. In a mobile loading machine having a frame and an operator's cab mounted thereon, a load arm assembly adapted to be pivotably mounted at a rear end to the frame, and to support a tool between a lowered position and a raised position at a forward end thereof, the load arm assembly comprising:

an outer load arm section for supporting the tool;

an inner load arm section pivotably mounted to the frame, wherein the inner load arm section has an upper wall, a lower wall and a pair of connecting side segments, an intermediate load arm section connected between the outer and inner load arm sections, wherein the intermediate load arm section has a top wall, a bottom wall and a pair of connecting sidewalls extending downwardly beyond the bottom wall, wherein the upper wall and the side segments of the inner load arm section are slidably received within the top wall and the sidewalls of the intermediate load arm section; and a brace connecting the bottom wall of the intermediate load arm section with the lower wall of the inner load arm section;

wherein the upper wall and connecting sidewalls of the intermediate load arm section overlap the upper wall and side segments of the inner load arm section and are fixed thereto in a joint, wherein the intermediate load arm section is positioned alongside a lowermost portion of the cab and the inner load arm section projects upwardly and rearwardly of the cab from the intermediate load arm section, when the load arm assembly is in the lowered position, to maximize the lateral visibility of the operator from the cab.

5. The load arm assembly of claim 1, wherein the inner load arm section extends downwardly and forwardly between the frame and the cab from an upper pivot connection area at which the inner load arm section is pivotably mounted to the frame, the intermediate load arm section extends downwardly and forwardly alongside the cab from the joint and the outer load arm section extends substantially downwardly in front of the cab when the load arm assembly is in the lowered position.

6. The load arm assembly of claim 1, wherein the bottom wall of each of the inner and intermediate load arm sections comprises a channel member, wherein the channel members at the joint are spaced from each other, and wherein the joint further includes a bottom plate extending between and interconnected to the channel members defining the bottom walls of the inner and intermediate load arm sections, respectively.

7. In a loading machine having a load arm assembly having a top wall and a bottom wall connected by a pair of sidewalls for supporting a power tool fed by a supply line arrangement running alongside the load arm assembly, the improvement comprising:

an extended sidewall portion extending past the bottom wall and cooperating with the bottom wall to define a recess; and a retaining device interconnected with the load arm assembly and the supply line arrangement and disposed within the recess for retaining the supply line arrangement relative to the bottom wall, wherein the extended sidewall portion functions to protect and conceal the supply line arrangement within the recess.

8. In a mobile loading machine, a movable load arm assembly for supporting a power tool connected with a supply line arrangement, the load arm assembly comprising:

an inverted, generally U-shaped channel defining a top wall and a pair of spaced apart sidewalls depending therefrom;

a bottom wall connected across the sidewalls and closing the U-shaped channel to form a tubular support member; and a clamping device secured to the bottom wall for retaining the supply line arrangement adjacent thereto;

wherein the bottom wall and the depending sidewalls are constructed and arranged to define a recess within which the supply line arrangement and the clamping device are located to conceal, protect and allow accessibility to the supply line arrangement.

9. The load arm assembly of claim 8, wherein the depending sidewalls are substantially parallel to one another.

10. The load arm assembly of claim 8, wherein the bottom wall is substantially parallel to the top wall.

11. In a mobile loading machine, a movable load arm assembly for supporting a power tool connected with a supply line arrangement, the load arm assembly comprising:

an inverted, generally U-shaped channel defining a top wall and a pair of spaced apart sidewalls depending therefrom;

a bottom wall connected across the sidewalls and closing the U-shaped channel to form a tubular support member, wherein the bottom wall comprises an upright, U-shaped channel having a transverse portion and a pair of upright side portions, each of which is secured to an inside surface of a respective sidewall; and a clamping device secured to the bottom wall for retaining the supply line arrangement adjacent thereto, wherein the bottom wall and the depending sidewalls are constructed and arranged to conceal, protect and allow accessibility to the supply line arrangement.

12. The load arm assembly of claim 8, wherein the supply line arrangement includes a pair of hydraulic tubes for feeding hydraulic fluid to the hydraulic cylinder.

13. The load arm assembly of claim 8, wherein the clamping device includes:

an upper yoke member connected to the underside of the bottom wall;

a bottom yoke member engageable with the upper yoke member; and a fastener extending through aligned openings formed in the upper yoke member and the bottom yoke member and interconnected with the bottom wall so as to clampingly retain the supply line arrangement between the upper and lower yoke members beneath the bottom wall and between the depending sidewalls.

14. The load arm assembly of claim 8, wherein the depending sidewalls extend downwardly beyond the clamping device.

15. The load arm assembly of claim 8, wherein the loading machine is a skid steer loader.

16. A loading machine, comprising:

a frame;

a load arm assembly pivotably mounted to the frame;

a power device connected to the load arm assembly and movable between an extended position and a retracted position for respectively obtaining a raised condition and a lowered condition of the load arm assembly;

wherein the load arm assembly in the vicinity of the power device defines a closed interior and includes an external supply line arrangement for supplying fluid power to a tool adapted for mounting to the load arm assembly; and an anti-lowering arrangement located on the load arm assembly for selectively holding the power device in the extended position and preventing lowering of the load arm assembly, wherein the anti-lowering arrangement comprises a retainer bar pivotably mounted to a pair of walls associated with the load arm member and located exteriorly of the closed interior defined by the load arm member, wherein the retainer bar is pivotable between an inoperative position wherein the retainer bar is protectively retained between the walls and disengaged from the power device, and an operative position wherein the retainer bar is released from between the walls to pivot downwardly by gravity from between the walls into obstructing contact with the power device so as to prevent retraction of the power device and maintain the raised condition of the load arm assembly, and wherein the supply line arrangement is located between the retainer bar and a transverse wall forming a part of the load arm assembly and which extends between the pair of walls between which the retainer bar is located when in its inoperative position.

17. An anti-lowering arrangement for a loading machine having a frame, at least one load arm assembly pivotably connected to the frame and adapted to carry a tool and a power device associated with the load arm assembly and movable between a retracted position and an extended position for lowering and raising the load arm assembly, the anti-lowering arrangement comprising:

a retainer bar having a first end pivotably mounted to the load arm assembly and a second end movable between an inoperative position wherein the retainer bar is connected to the load arm assembly and spaced from the power device, and an operative position wherein, with the power device in the extended position, the retainer bar is released and pivots away from the load arm assembly into obstructing contact with the power device to hold the power device in the extended position and prevent lowering of the load arm assembly;

wherein the load arm assembly includes a load arm member defining a closed interior, a transverse wall, and a pair of external depending sidewalls between which the retainer bar is located when in its inoperative position, and wherein movement of the retainer bar to its operative position is operable to move the second end of the retainer bar outwardly from between the depending sidewalls;

wherein the load arm assembly carries one or more external supply lines for supplying power to the tool, and wherein the one or more supply lines are located between the retainer bar and the transverse wall.

18. The anti-lowering arrangement of claim 17, wherein the power device is a hydraulic cylinder having a rod portion telescopically mounted within a cylinder portion.

19. The anti-lowering arrangement of claim 17, wherein the retainer bar is formed as an inverted, U-shaped channel having an upper wall and a pair of depending sidewalls provided with a pair of aligned openings therethrough.

20. The anti-lowering arrangement of claim 19, wherein the depending sidewalls of the load arm assembly include aligned apertures, and further including a retaining pin passable through the aligned openings of the retainer bar and the aligned apertures of the load arm assembly for retaining the retainer bar in the inoperative position.

21. The anti-lowering arrangement of claim 20, wherein the length of the retaining pin is longer than the distance between the sidewalls of the load arm assembly so that the ends of the pin extend beyond the sidewalls of the load arm assembly when the retainer bar is in the inoperative position.

22. The anti-lowering arrangement of claim 17, wherein the retainer bar is concealed between the sidewalls of the load arm assembly when the retainer bar is in the inoperative position.

23. The anti-lowering arrangement of claim 18, wherein the loading machine is a skid steer loader.

24. In a skid steer loader including a frame, a load arm assembly extending between a forward end and a rearward end and movably interconnected with the frame at the rearward end, a first power device interconnected between the load arm assembly and the frame for effecting movement of the load arm assembly relative to the frame, and a second power device disposed toward the forward end of the load arm assembly and supplied by one or more supply lines, the improvement comprising:

a support arrangement interconnected between the load arm assembly and the one or more supply lines for securing the one or more supply lines to the load arm assembly; and wall structure forming a part of the load arm assembly, comprising a pair of spaced apart forwardly-to-rearwardly extending walls formed on the load arm assembly forwardly of the interconnection of the load arm assembly with the frame and rearwardly of the second power device, wherein the walls cooperate to define a forwardly-to-rearwardly extending recess on the exterior of the load arm assembly within which the support arrangement and the one or more supply lines are received, wherein the wall structure is constructed and arranged to protect and conceal the support arrangement and the one or more supply lines throughout at least a portion of the length of the one or more supply lines between the forward and rearward ends of the load arm assembly, wherein the load arm assembly includes a pair of spaced sidewalls and a bottom wall extending therebetween, and wherein at least one of the pair of spaced apart forwardly-to-rearwardly extending walls comprises an extension of one of the pair of spaced sidewalls extending past the bottom wall.

25. The improvement of claim 24, wherein the support arrangement is interconnected with the bottom wall.

26. The improvement of claim 24, wherein the pair of spaced apart forward-to-rearwardly extending walls comprises an extension of each of the pair of sidewalls, and wherein the first power device is interconnected with the sidewall extensions.

27. In a skid steer loader including a frame, a load arm assembly movably mounted to the frame and extending between a forward end and a rearward end, a first power device interconnected between the load arm assembly and the frame for effecting movement of the load arm assembly relative to the frame, and a second power device disposed toward the forward end of the load arm assembly and supplied by one or more supply lines, the improvement comprising:

a support arrangement interconnected between the load arm assembly and the one or more supply lines for securing the one or more supply lines to the load arm assembly; and wall structure associated with the load arm assembly, comprising a pair of spaced apart axially extending walls which cooperate to define an axially extending recess on the exterior of the load arm assembly within which the one or more supply lines are received, wherein the wall structure is constructed and arranged to protect and conceal the support arrangement and the one or more supply lines throughout at least a portion of the length of the one or more supply lines, wherein the load arm assembly includes a pair of spaced sidewalls and a bottom wall extending therebetween, and wherein at least one of the pair of spaced apart axially extending walls comprises an extension of one of the pair of spaced sidewalls extending past the bottom wall, and wherein the pair of spaced apart axially extending walls comprises an extension of each of the pair of sidewalls, and wherein the first power device is interconnected with the sidewall extensions, wherein the sidewall extensions define a forward portion and a rearward portion and a step therebetween, and wherein the first power device is interconnected with the forward portion of the sidewall extensions adjacent the step.

28. An anti-lowering arrangement for a loading machine having a frame, at least one load arm assembly pivotably connected to the frame and a power device associated with the load arm assembly and movable between a retracted position and an extended position for lowering and raising the load arm assembly, the anti-lowering arrangement comprising:

a retainer bar having a first end pivotably mounted to the load arm assembly and a second end movable between an inoperative position wherein the bar is connected to the load arm assembly and spaced from the power device, and an operative position wherein, with the power device in the extended position, the bar is released and pivots away from the load arm assembly into obstructing contact with the power device to hold the power device in the extended position and prevent lowering of the load arm assembly;

wherein the load arm assembly includes a pair of depending sidewalls between which the retainer bar is located when in its operative position, and wherein movement of the retainer bar to its operative position is operable to move the second end of the retainer bar outwardly from between the depending sidewalls;

wherein the at least one load arm assembly carries a power tool and a supply line arrangement for supplying fluid power to the power tool, and wherein the supply line arrangement is interposed between the retainer bar and a transverse wall of the load arm assembly which extends between the pair of depending side walls between which the retainer bar is located when in its inoperative position.

29. In a skid steer loader including a frame, a load arm assembly extending between a forward end and a rearward end movably interconnected with the frame at the rearward end, a first power device interconnected between the load arm assembly and the frame for effecting movement of the load arm assembly relative to the frame, and a second power device disposed toward the forward end of the load arm assembly and supplied by one or more supply lines, the improvement comprising:

a support arrangement interconnected between the load arm assembly and the one or more supply lines for securing the one or more supply lines to the load arm assembly; and wall structure forming a part of the load arm assembly and defining a forwardly-to-rearwardly recess on the exterior of the load arm assembly within which the support arrangement and the one or more supply lines are received, wherein the wall structure is constructed and arranged to protect and conceal the support arrangement and the one or more supply lines throughout at least a portion of the length of the one or more supply lines forwardly of the interconnection of the load arm assembly with the frame and rearwardly of the second power device, wherein the load arm assembly includes a pair of spaced sidewalls and a bottom wall extending therebetween, and wherein the wall structure defining the recess comprises an extension of at least one of the pair of spaced sidewalls extending past the bottom wall and cooperating with the bottom wall to form the recess.

30. In a skid steer loader including a frame, a load arm assembly movably mounted to the frame and extending between a forward end and a rearward end, a first power device interconnected between the load arm assembly and the frame and including an extendible and retractable member for effecting movement of the load arm assembly relative to the frame, and a second power device disposed toward the forward end of the frame and supplied by one or more supply lines, the improvement comprising a pair of spaced apart axially extending walls associated with the load arm assembly which cooperate to define an axially extending recess on the exterior of the load arm assembly within which the one or more supply lines are received, wherein the pair of spaced apart walls are constructed and arranged to protect and conceal the one or more supply lines throughout at least a portion of the length of the one or more supply lines, and wherein the spaced apart walls define a connection area to which the extendible and retractable member of the first power device is connected outwardly of the one or more supply lines.

31. The improvement of claim 30, wherein the connection area comprises an outward step defined by each of the spaced apart walls with which the extendible and retractable members is interconnected.

32. The improvement of claim 31, wherein the load arm assembly includes a pair of spaced sidewalls and a bottom wall extending therebetween, and wherein the pair of spaced apart walls comprises an extension of each of the pair of spaced sidewalls extending past the bottom wall.

33. A joint arrangement for a pair of load arm sections forming at least a part of a load arm assembly for a loading machine, comprising:

a first upper wall and a first lower wall forming a part of a first one of the load arm sections, wherein the first upper and lower walls diverge away from each other;

a second upper wall and a second lower wall forming a part of a second one of the load arm sections which cooperate to form at least a part of an opening in an end of the second load arm section;

wherein the first load arm section is received within the opening of the second load arm section, and wherein the walls of the load arm sections are constructed and arranged such that the first and second upper walls overlap each other and an end defined by the first lower wall is spaced from an end defined by the second lower wall, wherein the first and second upper walls are connected together at the location at which the first and second upper walls overlap each other, and wherein the first and second lower walls are connected together by means of a connecting member secured to each of the first and second lower walls and extending between the spaced ends defined by the first and second lower walls.

34. The joint arrangement of claim 33, wherein the second upper wall defines an outer section at the opening which cooperates to form an obtuse angle with an inner section located inwardly thereof, and wherein the first and second upper walls are connected together at the outer section of the first upper wall.

35. The joint arrangement of claim 34, wherein each of the load arm sections further includes a pair of spaced sidewalls, wherein the sidewalls of the load arm sections overlap each other at an overlapping area and are connected together at the overlapping area.

* * * * *

UNITED STATES PATENT AND TRADEMARK OFFICE

CERTIFICATE OF CORRECTION

PATENT NO. : 6,171,050 B1
DATED : January 9, 2001
INVENTOR(S) : Robert John Johnson It is certified that error appears in the above-identified patent and that said Letters Patent is hereby corrected as shown below:

Column 11, claim 17,
Line 13, after "tool" insert -- , --;

Column 12, claim 26,
Line 33, delete "forward" and substitute therefor -- forwardly -- ;

Claim 36,
Please add the following allowed claim which was omitted from the patent upon printing:

-- In a mobile loading machine having a frame and an operator's cab mounted thereon, a load arm assembly adapted to be pivotably mounted at a rear end to the frame, and to suppport a tool at a forward end for movement between a lowered position and a raised position, the load arm assembly comprising:

an outer load arm section for supporting the tool;
an inner load arm section pivotably mounted to the frame;
an intermediate load arm section connected between the inner and outer load arm sections;

wherein the intermediate load arm section and the inner load arm section extend along longitudinal axes which cooperate to define an angle, wherein the inner load arm section extends downwardly and forwardly from an upper pivot connection area at which the inner load arm section is pivotably mounted to the frame and terminates in a forward end, and wherein the intermediate load arm section defines a rearward end interconnected at a joint with the forward end of the inner load arm section and extends forwardly therefrom for connection to the outer load arm section, wherein the joint comprises a series of overlapping wall sections of the inner and intermediate load arm sections which are configured and arranged to form the angle between the inner and intermediate load arm sections;

UNITED STATES PATENT AND TRADEMARK OFFICE

CERTIFICATE OF CORRECTION

PATENT NO. : 6,171,050 B1
DATED : January 9, 2001
INVENTOR(S) : Robert John Johnson It is certified that error appears in the above-identified patent and that said Letters Patent is hereby corrected as shown below:

wherein one of the inner and intermediate load arm sections terminates in a top wall, a bottom wall and a pair of sidewall sections extending therebetween which cooperate to define an outwardly open passage and wherein the other of the inner and intermediate load arm sections is slidably received within the passage and includes a second top wall, a second bottom wall and a pair of second connecting sidewall sections extending therebetween, wherein the first-mentioned and second top walls are interconnected with each other, the first-mentioned and second bottom walls define spaced apart ends, and the first-mentioned and second sidewall sections overlap each other, and wherein the first-mentioned and second top walls and the first-mentioned and second sidewall sections are connected together by welding, and wherein the first-mentioned and second bottom walls are interconnected by means of a connecting member extending between the spaced apart ends defined by the first-mentioned and second bottom walls;

wherein, when the load arm assembly is in the lowered position, the intermediate load arm section extends alongside a lowermost portion of the cab and the inner load arm section projects upwardly and rearwardly therefrom to the upper pivot connection area to maximize the lateral visibility of an operator from the cab. --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*